United States Patent [19]

Fry

[11] Patent Number: 4,583,619

[45] Date of Patent: Apr. 22, 1986

[54] AUTOMATIC GATE FOR CHECKOUT LANE

[76] Inventor: Raymond A. Fry, P.O. Box 86482, San Diego, Calif. 92138

[21] Appl. No.: 524,745

[22] Filed: Aug. 19, 1983

[51] Int. Cl.[4] ..... A47F 9/04

[52] U.S. Cl. ..... 186/59; 49/349; 49/352

[58] Field of Search ..... 186/59–68, 186/52, 57; 49/323, 349, 352, 360

[56] References Cited

U.S. PATENT DOCUMENTS

| | | | |
|---|---|---|---|
| 1,544,949 | 7/1925 | Smiley | 186/58 X |
| 1,916,579 | 7/1933 | Mosher | 49/349 X |
| 3,182,357 | 5/1965 | Tuttle . | |
| 3,344,556 | 10/1967 | Edwards | 49/360 |
| 3,437,177 | 4/1969 | Close . | |
| 3,478,467 | 11/1969 | May . | |
| 3,633,311 | 1/1972 | Ulmann . | |
| 3,866,356 | 2/1975 | La Cook et al. . | |
| 3,960,420 | 6/1976 | Speraw et al. . | |
| 4,290,230 | 9/1981 | t'Kint de Roodenbeke . | |

FOREIGN PATENT DOCUMENTS 1424330 2/1976 United Kingdom .

*Primary Examiner*—F. J. Bartuska

*Attorney, Agent, or Firm*—Kerkam, Stowell, Kondracki, & Clarke

[57] ABSTRACT

A gate for a checkout lane is controlled by the cash register lock key. A cashier may insert the key to obtain access to the cash register and when the cash register is unlocked, the gate will automatically open allowing customers free egress from a checkout lane. When the cashier locks the cash register the gate automatically closes to block the checkout lane associated with that cash register. The gate is slidably mounted within a housing which also encloses a motor used to slide the gate back and forth. A pulley and cable arrangement are used to move the gate. Limit switches are included to cut off power to the gate at the limits of its travel.

18 Claims, 6 Drawing Figures

AUTOMATIC GATE FOR CHECKOUT LANE

BACKGROUND OF THE INVENTION

This invention relates to a gate as used in checkout lanes in supermarkets, department stores, or similar establishments.

The use of checkout gates and similar arrangements are well-known for securing unused checkout lanes. Since the modern supermarket or similar establishment includes a large number of checkout lanes for servicing customers during peak periods, the checkout lanes often go unused during less busy periods.

The most common technique for closing off checkout lanes is a chain pulled across the lane and usually fastened with a harness hook. However, this can be stepped over easily unless additional things, such as shopping carts or other equipment, are used to block passage through the checkout lane.

The prior art further includes numerous constructions for gates and checkout stands including the following patents:

| Patent No. | Inventor | Issuance Date |
|---|---|---|
| 3,182,357 | R. G. Tuttle | May 11, 1965 |
| 3,437,177 | G. Close | April 8, 1969 |
| 3,478,467 | G. H. May | Nov. 18, 1969 |
| 3,633,311 | C. Ulmann | Jan. 11, 1972 |
| 3,866,356 | La Cook et al | Feb. 18, 1975 |
| 3,960,420 | Speraw et al | June 1, 1976 |
| 4,290,230 | K. de Roodenbeke | Sept. 22, 1981 |

The Tuttle patent discloses a checkout arrangement including a number of entrance gates to insure fair handling of customers waiting in line for service.

The Close patent discloses a supermarket construction showing checkout stands arranged to speed up customer flow.

The May patent discloses a fare operated gate assembly wherein an individual places his fare within a machine and the machine slides a gate to open a passageway for the individual.

The Ulmann patent shows a gate which is actuated by electromagnetically operated levers to move in one direction and is actuated by an elastic return device to move in the opposite direction.

The La Cook et al patent discloses a gate which is pivotably mounted to close off access to ladders or stairwells.

The Speraw et al patent discloses a checkout system which is adaptable to different modes of operation depending on whether one or two persons is working at the checkout stand.

The t'Kint de Roodenbeke patent shows an electric motor driven U-shaped cross bar gate which pivots between an open and a closed position.

Although the above and other prior art gates have been generally useful, they have often been subject to one or more of numerous disadvantages. Some problems common with many prior art systems include complexity of construction, high cost of manufacture, high cost for maintenance, and relatively inconvenient operation.

Although the simple expedient of hooking a chain across a closed checkout lane is relatively low in cost, it is easy to overcome since one can usually go under the chain. Moreover, and as is common with checkout lane gating systems more generally, a cashier leaving a cash register may easily forget to secure the checkout lane closed.

OBJECTS AND SUMMARY OF THE INVENTION

Accordingly, it is an object of the present invention to provide a new and improved system for closing checkout lanes.

A more specific object of the present invention is to provide a system for closing checkout lanes wherein a gate is extremely convenient for the cashier to operate.

A further object of the present invention is to provide a system for closing checkout lanes wherein a gate changes state without the need for a cashier to take additional steps beyond what is normally done to secure the cash register.

Yet another object of the present invention is to provide a system for closing checkout lanes which is easy to integrate into currently used equipment.

A still further object of the present invention is to provide a system for closing checkout lanes which is relatively simple in operation and low in cost.

The above and other objects of the present invention which will become apparent as the description proceeds are realized by a system for closing checkout lanes comprising: a gate having a first state for preventing egress from a checkout lane and a second state allowing egress from the checkout lane; a cash register having a lock to lock the cash register closed; a lock actuator for actuating and deactuating the lock; and a gate controller operable to cause the gate to automatically assume its first state upon actuation of the lock and operable to cause the gate to automatically assume its second state upon deactuation of the lock. The gate controller includes a gate switch which changes state when the lock is actuated and when the lock is deactuated. The system further comprises a motor operably connected to change the state of the gate, and the gate switch controls power flow to the motor. The gate controller further includes a first limit switch to cut off power flow to the motor when the gate is fully closed and a second limit switch to cut off power flow to the motor when the gate is fully open. The gate is slidably mounted within a track and the first and second limit switches are adjustably mounted to the track. The system further comprises a housing, the motor being mounted therein and the gate slidably mounted therein; a first pulley is operably connected to the motor; and a cable operably connecting the first pulley to a second pulley. A gear reduction box may be used to operably connect the motor to the pulley. The gate controller is operable to slide the gate between its open and closed positions by turning on the motor to rotate the first and second pulleys. The cable is secured to the gate and the system further comprises spring-loaded rollers mounted to the gate.

The present invention may alternately be described as a system for closing checkout lanes comprising: a gate selectively disposable in a closed position blocking a checkout lane and an open position allowing passage through the checkout lane; a cash register having a lock to lock the cash register closed; and a lock actuator for actuating and deactuating the lock; and wherein the gate is operable to automatically assume its closed position upon actuation of the lock. The system further comprises a motor operable to move the gate from its open position to its closed position and a gate controller operable to control movement of the gate from its open position to its closed position by controlling power flow to the motor. The motor is further operable to move the gate from its closed position to its open position and the gate controller is further operable to control movement of the gate from its closed position to its open position.

The present invention may alternately be described as a system for closing checkout lanes comprising: a housing; a gate mounted for sliding in the housing between an open position and a closed position; a motor in the housing; a first pulley operably connected to the motor; a cable operably connecting the first pulley to a second pulley; and gate controller operable to slide the gate between its open position and closed positions by turning on the motor to rotate the first and second pulleys. The system further comprises a cash register having a lock to lock the cash register closed, a lock actuator for actuating and deactuating the lock, and wherein the gate controller is operable to cause the gate to automatically assume its closed position upon actuation of the lock. The gate controller is operable to cause the gate to automatically assume its open position upon deactuation of the lock.

BRIEF DESCRIPTION OF THE DRAWINGS

The above and other features of the present invention will be more readily understood by reference to the following detail description in conjunction with the accompanying drawings wherein like characters represent like parts throughout the several views and in which.

DETAIL DESCRIPTION OF THE PREFERRED EMBODIMENT

Figure 1:
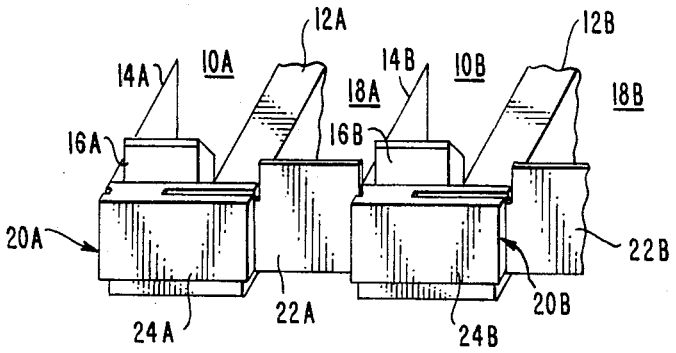
FIG. 1 shows a perspective view of two checkout stands according to the present invention.

Turning first to FIG. 1, the background for the present invention will be discussed. Specifically, FIG. 1 shows two parallel arranged checkout stands including spaces 10A and 10B for cashiers. Each cashier space such as 10A is in between an associated counter 12A and sidewall 14A. As will be readily appreciated, the two checkout stands are identical and the left one in FIG. 1 includes parts labeled with an A and the right one includes parts labeled with a B.

Each checkout stand includes a cash register such as 16A and an associated checkout lane such as 18A. As shown, the checkout lane 18A is in between counter 12A and sidewall 14B of the adjacent checkout stand. Likewise, the checkout stand having checkout lane 18B could have another checkout stand (not shown) on its right side.

Disposed at one end of counter 12A is the system 20A according to the present invention. System 20A includes a housing 24A and a gate 22A slidably mounted therein. Likewise, adjacent system 20B includes a gate 22B and housing 24B. As shown, the gate 22A extends between housing 24A and housing 24B when the gate 22A is closed to block off the checkout lane 18A. Likewise, gate 22B closes to the position shown in FIG. 1 to block off the checkout lane 18B. Specifically, gate 22B would either extend to an adjacent checkout stand or, alternately to a sidewall or partition in the store.

Figure 2:
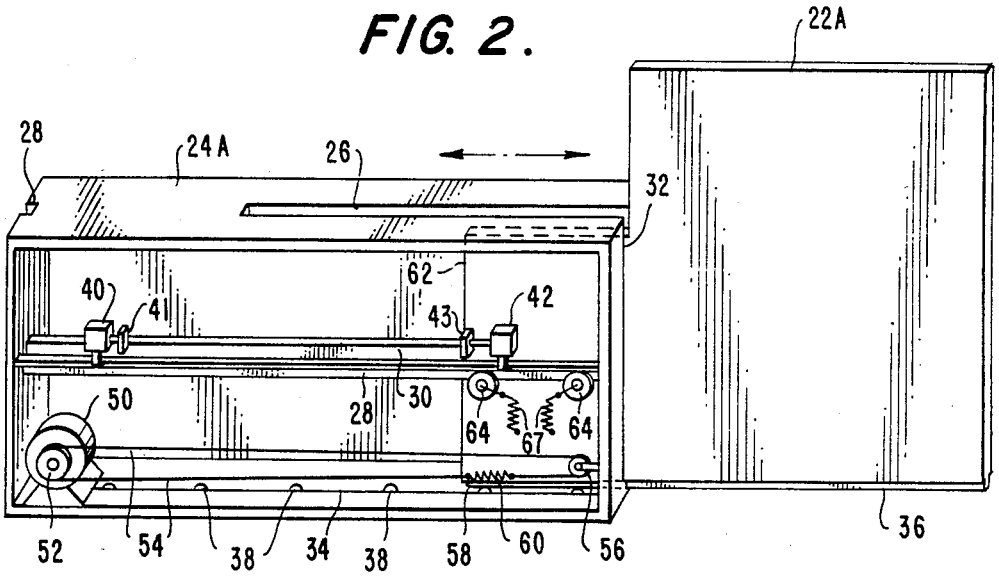
FIG. 2 shows a perspective view of a gate and its mounting in accordance with the present invention.

Turning now to FIG. 2, the detailed construction within housing 24A of the present invention will be discussed. The construction of the system 20B and its housing 24B would be identical. FIG. 2 shows a perspective front view of the housing 24A with its front cover removed. The housing 24A includes a slot 26 in which the gate 22A is slidably mounted. Additionally, the housing 24A includes a notch 28 adapted to receive a gate (not shown) from an identical system situated on the left of the housing 24A.

Figure 3:
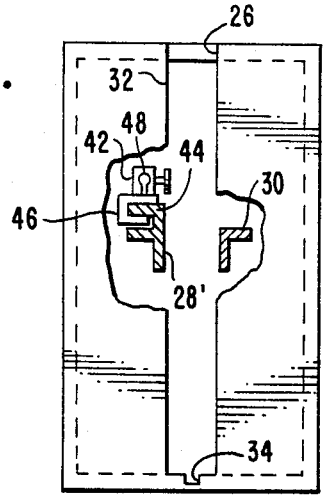
FIG. 3 shows an end view in partial breakaway of a gate housing according to the present invention.

Continuing to view FIG. 2, but also considering the view of FIG. 3, the guides 28 and 30 will be discussed. FIG. 3 shows a slightly different guide 28′ discussed below. Specifically, the guides 28 and guides 30 are disposed interior to the housing 24A and extend lengthwise completely from the end of 24A which includes notch 28 to the opposite end of the housing 24A. The horizontal slot 26 extends to a vertical slot 32. At the bottom of slot 32 is a groove 34 which extends below and parallel to the complete length of the angle iron guides 28 and 30. The groove or track 34 may have metal guide pieces 38 (shown in FIG. 2 only) which help to hold the gate 22A within the groove 34. Specifically, a tongue 36 on the bottom of gate 22A rides within the groove 34.

Mounted upon the angle iron guide 28 (or 28′) are two limit switches 40 and 42, both of which are microswitches having respective arms 41 and 43. Specifically, the limit, switch 40 corresponds to the gate 22A being in a closed position, whereas the limit switch 42 corresponds to the gate 22A being in an open position as shown in FIG. 2. Limit switch 40 is normally closed, whereas limit switch 42 is normally open. The limit switches 40 and 42 may simply be welded or adhered to the angle iron 28 as shown in FIG. 2. Alternately, the limit switches 40 and 42 could be selectively disposable along different locations of the angle iron 28. Numerous techniques could be used for providing the adjustability feature, but a specific technique is shown in FIG. 3 wherein an alternate angle iron guide 28′ includes an upper arm 44 upon which the limit switches 40 and 42 (only switch 42 is visible in the view of FIG. 3) may be mounted. The limit switch 42 as shown in FIG. 3 is attached to a C clamp 46 which is bolted to upper arm 44 by the bolt 48. The C clamp 46 and bolt 48 may be used to mount the switch 42 any place along the length of the angle iron 28′. If desired, the limit switch 40 could be mounted in similar fashion to that shown for limit switch 42 in FIG. 3.

A motor gear box combination 50, shown in FIG. 2 only, is mounted upon the floor of housing 24A adjacent the notch 28 end of the housing 24A. A first pulley 52 is mounted for rotation by the gear box of the motor unit 50. The gear box of motor unit 50 reduces the R.P.M. from the motor so that the pulley will rotate at a preferred value of 60 R.P.M. A cable 54 connects the pulley 52 to a second pulley 56. The second pulley 56 is mounted upon the same wall of housing 24A which has the slot 32. The cable 54 is attached to the gate 22A at point 58 and a spring 60 extends from point 58 to connect to the cable 54. The cable 54 may extend around the pulley 52 three times between its connecting point to the spring 60 and its mounting point 58.

Figure 4:
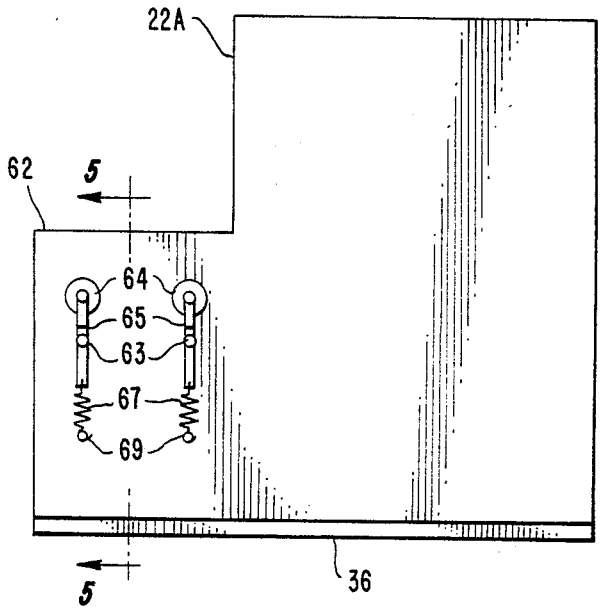
FIG. 4 shows a plane front view of a gate according to the present invention.
Figure 5:
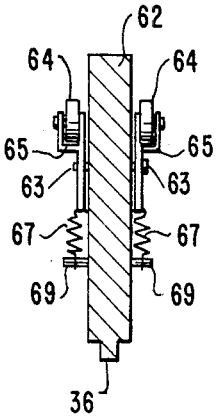
FIG. 5 shows a view taken along lines 5—5 of FIG. 4.

Continuing to consider FIG. 2, but also considering FIGS. 4 and 5, the gate 22A and associated parts will be discussed. The gate 22A is L-shaped as shown and includes a base portion 62 extending out therefrom. Two spring loaded rollers 64 are mounted upon each side of the base portion 62 of gate 22A. As shown, the spring loaded rollers 64 are mounted on arms 65 pivotably attached to the gate 22A at points 63. The mounting arms 65 are additionally attached to springs 67 having their opposite ends fixed to mounting post 69.

The gate 22A is loaded into housing 24A with the tongue 36 extending in groove 34. The angle iron guides 28 (or 28') and 30 help to stabilize the gate 22A in a vertical position. As best shown in FIG. 2, the spring loaded rollers 64 are placed under tension and will ride along the lower surfaces of the angle irons 28 and 30. The rollers 64 maintain downward pressure on the gate 22A to stabilize it.

Figure 6:
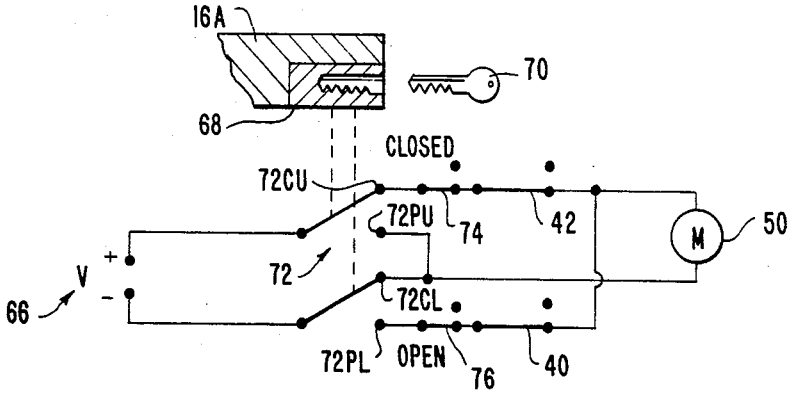
FIG. 6 shows a schematic circuit diagram of the gate controller according to the present invention.

Turning now to FIG. 6, a circuit schematic shows the gate controller or gate controlling circuit of the present invention. In particular, the DC motor 50 is supplied power from a power or voltage source 66. The power supply 66 is preferably a DC voltage obtained rectifying AC power as commonly available in supermarkets or other stores. Power flow to the motor 50 is controlled by the double pull double throw gate switch 72 which is in turn controlled by the lock or locking cylinder 68 in the cash register 16A.

The use of a locking cylinder or lock 68 in a cash register is well-known in the art. Commonly, the cashier uses a key 70 to obtain access to the cash register 16A. When the cashier leaves the cash register, he or she will lock the cash register with key 70 and carry the key away. However, instead of merely locking the cash register 16A by having the locking cylinder 68 control a lever or numerous other devices well-known in the art for locking cash registers, the present invention has the gate switch 72 mechanically linked to the lock 68 as depicted by the dotted lines. The mechanical linkage may be accomplished in a number of ways well-known in the prior art.

The upper closed position terminal 72CU of switch 72 is connected to the motor 50 by way of interlock switch 74 and limit switch 42. The lower closed position terminal 72CL of gate switch 72 is directly connected to the motor 50. The switch 72 also includes open position terminals 72PU and 72PL. Terminal 72PU is directly connected to the motor 50, whereas 72PL is connected to motor 50 by way of interlock switch 76 and limit switch 40.

Operation

The operation of the present invention will now be discussed in detail. When a cashier initially goes up to cash register 16A, the gate 22A will be in its closed position shown in FIG. 1. The cashier will insert a key 70 to unlock the lock 68 and obtain access to the cash register 16A. However, instead of merely unlocking the cash register 16A, the lock 68 will change the state of the switch 72 from its closed state shown in FIG. 6 to an open state. Specifically, power will now be supplied to terminals 72PU and 72PL. This in turn will supply power to motor 50 since interlock switch 76 and limit switch 40 are closed as shown. Accordingly, the motor 50 will rotate the pulley 52 (FIG. 2) in a clockwise direction to pull the gate 22A into its housing 24A. As the gate 22A slides to the left in FIG. 2, the point 58 at which the cable 54 is fixed to the gate is pulled closer to the motor 50. Finally, when the base portion 62 of gate 22A becomes adjacent to the switch arm 41 of normally closed limit switch 40, it will push in on the limit switch arm 41 and open the limit switch 40. This in turn cuts off power to the motor 50 and stops the gate from sliding any further to the left. Accordingly, the gate will be completely disposed within slot 26 and the checkout lane 18A will be completely open.

Most advantageously, the cashier did not need to take any additional steps to open the gate 22A. Instead, the unlocking of the cash register 16A automatically opened the gate 22A. The cashier may now service customers who may freely pass through checkout lane 18A.

When the cashier is ready to leave the cash register 16A, he or shes may simply remove the lock actuating key 70. This in turn will change the gate switch 72 to its closed position which is shown in FIG. 6. Electric power will now flow to the motor 50 from closed position terminals 72CU and 72CL, interlock switch 74 and limit switch 42 being closed. The motor 50 which is preferably a ⅛ or 1/16 hp reversible motor, now causes the pulley 52 to rotate in a counter clockwise direction, thereby pulling the gate (by way of pulley 56) to the right. The limit switch 42 will remain closed until the switch arm 43 has been cleared by the base portion 62, and the switch 42 resumes its normally open position. When this happens, the switch 42 will open and power to the motor 50 will be cut off. The gate 22A will now be fully closed and blocking the checkout lane 18A.

By having one or both of limit switches 40 and 42 adjustable as shown in FIG. 3, the points at which the motor 52 is cut-off from power can be varied. For example, if checkout lane 18A is only 18 inches wide the limit switch 42 will be moved on guide 28' three inches to the right of its position for a 21 inch checkout lane ($21-18=3$).

The interlock switches 74 and 76 will usually be kept in the position shown in FIG. 6. However, if one desires access to the cash register without opening the gate, the switch 76 could be switched into its open position. Likewise, if one desires to leave the gate 22A open even when the cash register 16A will be locked, the switch 74 may be opened prior to removal of the key 70. Either of the two interlock switches 74 and 76 thus may be used to defeat the control of the gate 22A by the lock actuating key 70.

Although specific constructions have been illustrated herein, it is to be understood that these are for illustrative purposes only. Various modifications and adaptations of the present invention will be apparent to those of ordinary skill in the art. For example, instead of key 70, a cash register adapted to operate when the cashier inserts a magnetic key card or other cash register unlocking arrangement could be used for operating a checkout lane gate in accordance with the teaching of the present invention. Moreover, instead of opening and closing the gate, the present invention could simply lock and unlock a turn-style type of gate depending upon whether the cash register was locked or unlocked. Of course, a turn-style type of gate is not as secure as a sliding gate such as 22A shown for the preferred embodiment. The motor could alternately be a reversible AC motor with the gate controlling circuit modified to cause AC power to rotate the motor in opposite directions depending on the position (locked or unlocked) of lock cylinder 68. Because so many modifications and adaptations of the present invention are possible, the scope of the present invention should be determined by reference to the claims appended hereto.

What is claimed is:

1. A system for closing checkout lanes comprising:
(a) a gate having a first state for preventing egress from a checkout lane and a second state allowing egress from said checkout lane;
(b) a cash register adjacent to said checkout lane and having a lock to lock said cash register closed; and
(c) a lock actuator for actuating and deactuating said lock; and
(d) a gate controller uniquely associated with said gate and uniquely associated with said lock and operable to cause said gate to automatically assume its first state upon actuation of said lock and operable to cause said gate to automatically assume its second state upon deactuation of said lock.

2. The system of claim 1 wherein said gate controller includes a gate switch which changes state when said lock is actuated and when said lock is deactuated.

3. The system of claim 2 further comprising a motor operably connected to change the state of said gate, and wherein said gate switch controls power flow to said motor.

4. The system of claim 3 wherein said gate controller further includes a limit switch to cut off power flow to said motor when said gate is fully closed and a second limit switch to cut off power flow to said motor when said gate is fully open.

5. The system of claim 4 wherein said gate is slidably mounted within a track and said first and second limit switches are adjustably mounted to said track.

6. The system of claim 1 further comprising a motor operably connected to change the state of said gate and wherein said gate controller controls the flow of power to said motor.

7. The system of claim 6 further comprising:
a housing, said motor being mounted therein and said gate slidably mounted therein;
a first pulley operably connected to said motor; and
a cable operably connecting said first pulley to a second pulley; and
wherein said gate controller is operable to slide said gate between its open and closed positions by turning on said motor to rotate said first and second pulleys.

8. The system of claim 7 wherein said cable is secured to said gate, and further comprising spring-loaded rollers mounted to said gate.

9. A system for closing checkout lanes comprising:
(a) a gate selectively disposable in a closed position blocking a checkout lane and an open position allowing passage through said checkout lane;
(b) a cash register adjacent to said checkout lane and having a lock to lock said cash register closed; and
(c) a lock actuator for actuating and deactuating said lock; and
wherein said gate is operable to automatically assume its closed position upon actuation of said lock and further comprising a motor operable to move said gate from its open position to its closed position and a gate controller operable to control movement of said gate from its open position to its closed position by controlling power flow to said motor, said gate controller uniquely associated with said gate and uniquely associated with said lock and operable to cause said gate to automatically assume its closed position upon actuation of said lock.

10. The system of claim 9 wherein said gate controller includes a gate switch which changes state when said lock is actuated and when said lock is deactuated.

11. The system of claim 10 wherein said gate controller includes a first limit switch to cut off power flow to said motor when said gate is fully closed and a second limit switch to cut off power flow to said motor when said gate is fully open.

12. The system of claim 11 further comprising a motor operably connected to change the state of said gate, and wherein said gate switch controls power flow to said motor.

13. The system of claim 9 wherein said motor is further operable to move said gate from its closed position to its open position and said gate controller is further operable to control movement of said gate from its closed position to its open position.

14. The system of claim 9 further comprising:
a housing, said motor being mounted therein and said gate slidably mounted therein;
a first pulley operably connected to said motor; and
a cable operably connecting said first pulley to a second pulley; and
wherein said gate controller is operable to slide said gate between its open and closed positions by turning on said motor to rotate said first and second pulleys.

15. A system for closing checkout lanes comprising:
(a) housing;
(b) a gate mounted for sliding in said housing between an open position and a closed position;
(c) a motor in said housing;
(d) a first pulley operably connected to said motor;
(e) a cable operably connecting said first pulley to a second pulley; and
(f) a gate controller operable to slide said gate between its open and closed positions by turning on said motor to rotate said first and second pulleys, and
further comprising a cash register having a lock to lock said cash register closed, a lock actuator for actuating and deactuating said lock, and wherein said gate controller is uniquely associated with said gate and uniquely associated with said lock and operable to cause said gate to automatically assume its open position upon deactuation of said lock.

16. The system of claim 15 wherein said gate controller is operable to cause said gate to automatically assume its closed position upon actuation of said lock.

17. The system of claim 16 wherein said cable is secured to said gate, and further comprising spring-loaded rollers mounted to said gate.

18. The system of claim 15 wherein said gate controller further includes a first limit switch to cut off power flow to said motor when said gate is fully closed and a second limit switch to cut off power flow to said motor when said gate is fully open.

* * * * *